United States Patent [19]

Thiis-Evensen

[11] 4,317,853

[45] * Mar. 2, 1982

[54] ROOFING SHINGLE

[75] Inventor: Eyvind M. Thiis-Evensen, Eidanger, Norway

[73] Assignee: Isola Fabrikker A/S, Eidanger, Norway

[ * ] Notice: The portion of the term of this patent subsequent to Feb. 19, 1997, has been disclaimed.

[21] Appl. No.: 146,271

[22] Filed: May 5, 1980

Related U.S. Application Data

[63] Continuation of Ser. No. 27,039, Apr. 4, 1979, abandoned, which is a continuation-in-part of Ser. No. 952,731, Jun. 1, 1978, Pat. No. 4,195,461, which is a continuation-in-part of Ser. No. 893,974, Apr. 6, 1978, Pat. No. 4,188,763.

[30] Foreign Application Priority Data

Apr. 14, 1977 [NO] Norway ..... 771308

[51] Int. Cl.[3] ..... B32B 5/16; B32B 11/10

[52] U.S. Cl. ..... 428/80; 427/186; 428/141; 428/143; 428/195; 428/281; 428/282; 428/291; 428/323; 428/326; 428/332; 428/354

[58] Field of Search ..... 428/80, 141, 143, 144, 428/147, 40, 161, 162, 323, 326, 281, 282; 52/420, 518, 520, 539, 551; 427/186; 420/332, 195, 354, 291

[56] References Cited

U.S. PATENT DOCUMENTS

| | | | |
|---|---|---|---|
| 2,270,734 | 1/1942 | Kirschbraun | 428/143 |
| 2,548,029 | 4/1951 | Kurtz et al. | 428/147 |
| 2,863,405 | 12/1958 | Liebrook et al. | 52/420 |
| 3,031,325 | 4/1962 | Roberts | 428/326 |
| 3,903,340 | 9/1975 | Shepherd | 428/143 |
| 4,188,763 | 2/1980 | Thiis-Evensen | 52/557 |
| 4,195,461 | 2/1980 | Thiis-Evensen | 52/557 |

*Primary Examiner*—Paul J. Thibodeau

*Attorney, Agent, or Firm*—Watson, Cole, Grindle & Watson

[57] ABSTRACT

Disclosed is a shingle having an enhanced relief effect which simulates roofing slate or roofing tile. The enhanced relief effect is provided by covering at least a portion of the underside of the shingle with a layer of particulated material such as spheres of expanded polystyrene, rubber particles, cork particles or other soft, elastic and resilient particles. The shingle further includes a stiffening layer over the layer of particulated material which tends to reduce the elasticity of the shingle.

18 Claims, 3 Drawing Figures

ROOFING SHINGLE

CROSS REFERENCE TO RELATED APPLICATIONS

This application is a continuation application of application Ser. No. 27,039, filed Apr. 4, 1979, now abandoned, which was a continuation-in-part of application Ser. No. 952,731 filed June 1, 1978, now U.S. Pat. No. 4,195,461, which in turn was a continuation-in-part of application Ser. No. 893,974, filed Apr. 6, 1978, now U.S. Pat. No. 4,188,763.

BACKGROUND OF THE INVENTION

The present invention relates to a covering element, preferably for roofs, of the type commonly known as a shingle. In the publically accessible Norwegian application No. 75.2695, a particular type of covering element is described in which a plastic film covering an asphalt layer on the underside of the shingle is further coated with a release agent.

It is common practice that covering elements of the type described in Norwegian application No. 75.2695, as well as conventional shingle types in which the plastic film is not coated with a release agent, are shaped in such a manner that the shingle will to some simulate roofing slate or roofing tile when mounted on a roof. The conventional shingle can be of the general type described in U.S. Pat. No. 2,863,405 and a particularly preferred embodiment is a shingle provided with "tongues" such as illustrated in FIG. 6 of U.S. Pat. No. 2,863,405. However, since the known shingle types normally have a thickness in the range 3–4 mm, they will not provide the same relief effect which can be obtained by the normally thicker roofing tiles when laid on a roof.

The present invention provides a shingle type which has a thickness such that the laid shingle will better simulate a roofing tile and hence will give an enhancement relief effect.

In Danish Pat. No. 105,177, a bituminous roofing felt is claimed, the complete underside of which is covered with a layer of porous, particulated particles of fired clay. The purpose of the particulated material is to provide ventilation in order that trapped moisture, for instance from a concrete substrate, can be permitted to escape via the channels formed by the particulated material.

SUMMARY OF THE INVENTION

As mentioned above, an object of the instant invention is to provide a shingle type which, when laid, will exhibit an improved esthetic appearance by having an enhanced relief effect.

Another object is to provide a roofing shingle which utilizes inexpensive materials, preferably recycled materials.

A further object of the present invention is to provide a shingle which has reduced elasticity or increased stiffness which facilitates the manufacture of the shingle and allows the shingle to be handled more easily during installation.

These objects are obtained by providing a layer of particulated light material on the underside surface of a shingle and providing a stiffening layer over the of particulated material. The particulated light material may be spheres of expanded polystyrene or a similar soft, elastic and resilient particulated material such as rubber particles, cork particles, or polymeric particles having a diameter of at least 1 mm, preferably in the range of 1–6 mm. The stiffening layer may be a material selected from plastic film, paper, glass fiber tissue, felt or other similar material.

Further objects, advantages and features of the invention will become more fully apparent from a consideration of the constituent parts of the invention as set forth in the following specification taken together with the accompanying drawing.

DETAILED DESCRIPTION OF THE PREFERRED EMBODIMENT

Figure 1:
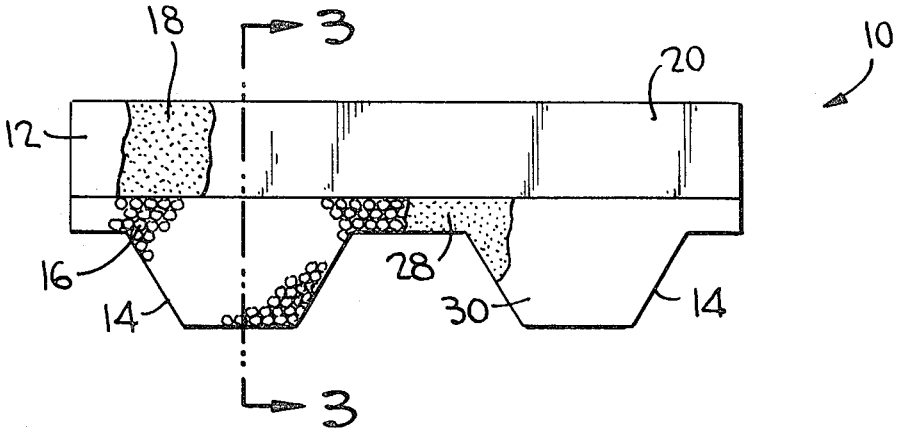
FIG. 1 is a bottom view of a preferred shingle in accordance with the present invention, a portion of the stiffening layer not shown so as to illustrate the layer of particulate material.

Referring now to FIG. 1, there is shown a shingle 10 which is a preferred embodiment of the present invention. Shingle 10 includes a web 12 of felt, glass fiber tissue or like material impregnated with asphalt or bitumen. Web 12 has a generally rectangular shape with one or more extending three-sided tongues 14. Covering the tongues 14 and a portion of the remainder of the web 12 is a layer of spheres 16 of expanded polystyrene.

The portions of web 12 not covered by layer of spheres 16 preferably have a coating of adhesive 18 which facilitates the retention of the shingle to a roof surface. The coating of adhesive 18 may further be covered with a peelable plastic film 20 which protects the adhesive prior to installation of shingle 10.

It is preferred that only the tongues 14 of shingle 10 and that portion of the shingle which is not in contact with the roof structure be covered with a monolayer of the spheres 16, i.e., only the part of the shingle which is overlapping the underlying layer of the adjacent shingles should be covered with the spheres. Such a construction facilitates the fixing of the shingle 10 to the roof structure. However, the entire bottom surface of shingle 10 could be provided with a monolayer of spheres 16.

Shingles 10 further includes stiffening layer 30 over layer of spheres 16 so that a "triplex" type shingle is formed comprising web 12, the layer of spheres and the stiffening layer. In FIG. 1, a portion of layer 30 has not been shown so that layer of spheres 16 may be illustrated. The material for stiffening layer 30 may be selected from plastic film, paper, glass fiber tissue, felt or other similar materials. The inclusion of stiffening layer 30 tends to reduce the elasticity of shingle 10 which thereby facilitates the cutting and packing operations in the manufacture of the shingles and also allows the shingle to be handled more easily when being laid on a roof or the like due to the increased stiffness of the shingle. The increased stiffness also will prevent the shingle from being blown up by wind when laid.

Stiffening layer 30 may be attached to the layer of spheres 16 by applying an adhesive 28 to the layer of spheres and subsequently applying the stiffening layer to the adhesive. For example, web 12 of shingle 10 with layer of spheres 16 already applied may be brought into contact with an adhesive application rollers so as to apply a suitable adhesive 28 such as melted asphalt onto the layer of spheres, and then applying stiffening layer 30 to the adhesive. In practice, it has been found advantageous to apply stiffening layer 30 to shingle 10 just before web 12 is cut to individual shingles. In this manner, the elasticity of shingle 10 can be utilized in the manufacturing process and the desired and advantageous stiffness provided by the addition of layer 30 may be utilized in the cutting operation and in the subsequent finishing, packaging and handling operations for the shingles.

Figure 2:
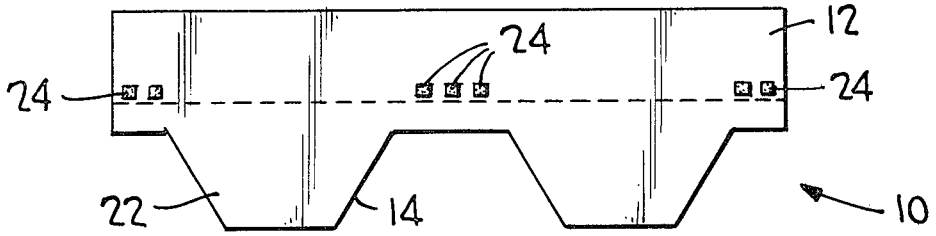
FIG. 2 is a top view of the shingle of FIG. 1.

FIG. 2 illustrates the top surface of the shingle 10 of FIG. 1. The surface of shingle 10 is provided with a pattern 22 for simulating roofing slate or roofing tile. In addition, the surface of shingle 10 has areas 24 which have an adhesive coating. The adhesive areas 24 help to secure and interlock the shingle to overlapping shingles when the shingle is installed on a roof.

Figure 3:
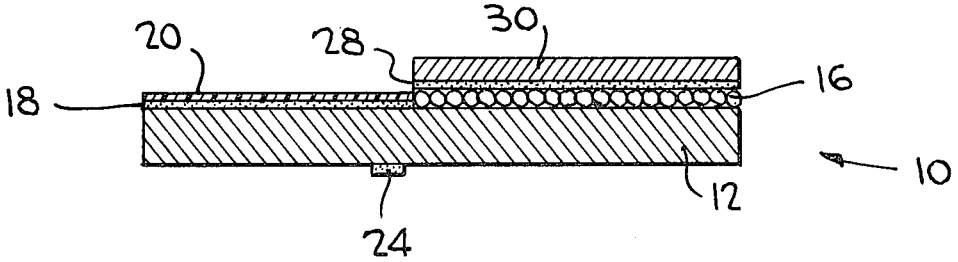
FIG. 3 is an enlarged cross-sectional view of the shingle of FIG. 1 taken along line 3—3.

FIG. 3 is a cross-sectional view of the shingle of FIG. 1 along line 3—3. The cross-sectional view is of course not drawn to scale in order to more clearly show the construction of shingle 10. Shingle 10 includes web 12 and the layer of spheres 16 on a portion of the one surface of the web. Over layer of spheres 16 is adhesive 28 joining the layer to stiffening layer 30. On the remaining portion of this surface of shingle 10 are adhesive coating 18 and optionally peelable plastic film 20. On the opposite surface of web 12 is an area of adhesive 24.

In addition to improving the esthetic appearance of the laid shingles, a layer of, for instance, expanded polystyrene, spheres will also improve the insulating properties of the laid roof as shingles usually are laid with approximately 5 cm overlap. The improved insulation can be of importance in countries with cold winter climate. Furthermore, the monolayer of the expanded spheres will also reduce the noise caused by heavy rain. Thus, by providing shingles with a monolayer of spherical material such as expanded polystyrene with the above-mentioned diameter, it is possible to increase the "effective" thickness of a portion of the shingle without a significant increase in the weight of the shingle. The most effective relief effect is obtained when using dark colored spheres such as black spheres.

Although the above description has been directed to shingle 10 utilizing a layer of spheres 16 of expanded polystyrene, shingles in accordance with the present invention may also utilize other soft, elastic and resilient particulated materials in lieu of spheres of polystyrene to provide the same or similar advantages set forth in the preceeding paragraph. Such soft, elastic and resilient particulated materials include cork particles, rubber particles or other expanded or non-expanded polymer particles. The use of these soft, elastic and resilient particulated materials in shingles allows the shingles to be easily cut by the knives of a cutting machine in the shingle manufacturing operation. When rubber particles are utilized, preferably these particles are produced by grinding or disintegrating worn or unusable vehicle tires such as automobile tires so as to significantly reduce material costs for the shingles by using recycled materials. Such rubber particles have a further advantage in that they are generally of a dark or black color which, as was mentioned above, provides the most effective relief effect for shingles.

While there has been shown and described what is considered to be preferred embodiments of the present invention, it will be obvious to those skilled in the art that various changes and modifications may be made therein without departing from the invention as defined in the appended claims.

I claim:

1. A roofing shingle which comprises a generally flat web having a top surface and a bottom surface, said web including a generally rectangular main portion and at least one tongue portion extending away therefrom, a monolayer of rubber particles covering the tongue portion and a part of the main portion of said web on the bottom surface thereof, said rubber particles having the diameter of at least 1 mm, a layer of adhesive coated on the bottom surface of said web not covered by said monolayer of rubber particles, a layer of stiffening material attached to at least a part of the monolayer of rubber particles on the side thereof opposite the web, and an adhesive coating on at least a part of the top surface of said web.

2. The roofing shingle of claim 1 wherein said web includes an impregnant selected from the group of asphalt and bitumen.

3. The roofing shingle of claim 1 wherein said web is composed of felt.

4. The roofing shingle of claim 1, wherein said web is composed of glass fiber tissue.

5. The roofing shingle of claim 1 wherein a plastic film is positioned on said layer of adhesive coated on the bottom surface of said web on the side thereof opposite said web.

6. The roofing shingle of claim 1 wherein the diameter of said rubber particles is between 1 and 6 mm.

7. The roofing shingle of claim 1 wherein a layer of adhesive is located between said monolayer of rubber particles and the bottom surface of said web.

8. The roofing shingle of claim wherein said adhesive coating on at least a part of the top surface of said web comprises spaced apart patches of adhesive located on the main portion of the web top surface.

9. The roofing shingle of claim 1 wherein said stiffening material is selected from the group consisting of plastic film, paper, glass fiber tissue and felt.

10. A roofing shingle which comprises a generally flat web having a top surface and a bottom surface, said web including a generally rectangular main portion and at least one tongue portion extending away therefrom, a monolayer of cork particles covering the tongue portion and a part of the main portion of said web on the bottom surface thereof, said cork particles having the diameter of at least 1 mm, a layer of adhesive coated on the bottom surface of said web not covered by said monolayer of cork particles, a layer of stiffening material attached to at least a part of the monolayer of cork particles on the side thereof opposite the web, and an adhesive coating on at least a part of the top surface of said web.

11. The roofing shingle of claim 10 wherein said web includes an impregnant selected from the group of asphalt and bitumen.

12. The roofing shingle of claim 10 wherein said web is composed of felt.

13. The roofing shingle of claim 10 wherein said web is composed of glass fiber tissue.

14. The roofing shingle of claim 10 wherein a plastic film is positioned on said layer of adhesive coated on the bottom surface of said web on the side thereof opposite said web.

15. The roofing shingle of claim 10 wherein the diameter of said cork particles is between 1 and 6 mm.

16. The roofing shingle of claim 10 wherein a layer of adhesive is located between said monolayer of cork particles and the bottom surface of said web.

17. The roofing shingle of claim 10 wherein said adhesive coating on at least a part of the top surface of said web comprises spaced apart patches of adhesive located on the main portion of the web top surface.

18. The roofing shingle of claim 10 wherein said stiffening material is selected from the group consisting of plastic film, paper, glass fiber tissue and felt.

* * * * *